US007051497B2

(12) United States Patent
Peterson et al.

(10) Patent No.: US 7,051,497 B2
(45) Date of Patent: May 30, 2006

(54) PORTABLE LADDER FOR MOUNTING A HORSE

(76) Inventors: Robert A. Peterson, 4538 Deyo Ave., Brookfield, IL (US) 60513; Katelyn J. Peterson, 4538 Deyo Ave., Brookfield, IL (US) 60513

( * ) Notice: Subject to any disclaimer, the term of this patent is extended or adjusted under 35 U.S.C. 154(b) by 0 days.

(21) Appl. No.: 10/818,840

(22) Filed: Apr. 6, 2004

(65) Prior Publication Data

US 2004/0200197 A1 Oct. 14, 2004

Related U.S. Application Data

(60) Provisional application No. 60/462,277, filed on Apr. 11, 2003.

(51) Int. Cl.
*B68C 1/02* (2006.01)

(52) U.S. Cl. ..... 54/44.1

(58) Field of Classification Search ..... 54/44.1
See application file for complete search history.

(56) References Cited

U.S. PATENT DOCUMENTS

| | | | | |
|---|---|---|---|---|
| D107,882 | S | 1/1938 | Nesbitt | |
| D214,570 | S | 7/1969 | Cohn | |
| D214,572 | S | 7/1969 | Cohn | |
| 3,907,064 | A * | 9/1975 | Svalberg et al. | 182/70 |
| 3,961,686 | A * | 6/1976 | Starkey | 182/187 |
| 4,177,878 | A | 12/1979 | Salvarezza | |
| D254,394 | S | 3/1980 | Leslie et al. | |
| 4,241,809 | A | 12/1980 | Salvarezza | |
| 4,442,920 | A | 4/1984 | Gronbeck et al. | |
| 4,531,612 | A * | 7/1985 | Sandor | 182/196 |
| 4,554,996 | A | 11/1985 | Salvarezza | |
| 4,846,306 | A | 7/1989 | Ventz | |
| 4,852,688 | A | 8/1989 | Strohmeyer, Sr. | |
| 5,074,236 | A * | 12/1991 | Robertson | 114/362 |
| 5,287,945 | A * | 2/1994 | Thurlow | 182/97 |
| 5,343,980 | A | 9/1994 | Elfanbaum | |
| 5,540,178 | A | 7/1996 | Damron | |
| 5,605,205 | A * | 2/1997 | Douglas et al. | 182/198 |
| 6,279,681 | B1 * | 8/2001 | Dibelardino et al. | 182/198 |
| 6,530,455 | B1 | 3/2003 | Arnette et al. | |

FOREIGN PATENT DOCUMENTS

| | | | |
|---|---|---|---|
| FR | 26007864 A1 * | 6/1988 | |
| GB | 2026074 A * | 1/1980 | |

* cited by examiner

*Primary Examiner*—Michael J. Carone
*Assistant Examiner*—Bret Hayes
(74) *Attorney, Agent, or Firm*—Brinks Hofer Gilson & Lione

(57) ABSTRACT

A portable ladder is presented for assisting a rider to mount a horse. The portable ladder is flexible and attaches to the saddle. The saddle need not be specially adapted to receive the portable ladder. The ladder may also be folded up for carrying or stowing while riding.

22 Claims, 4 Drawing Sheets

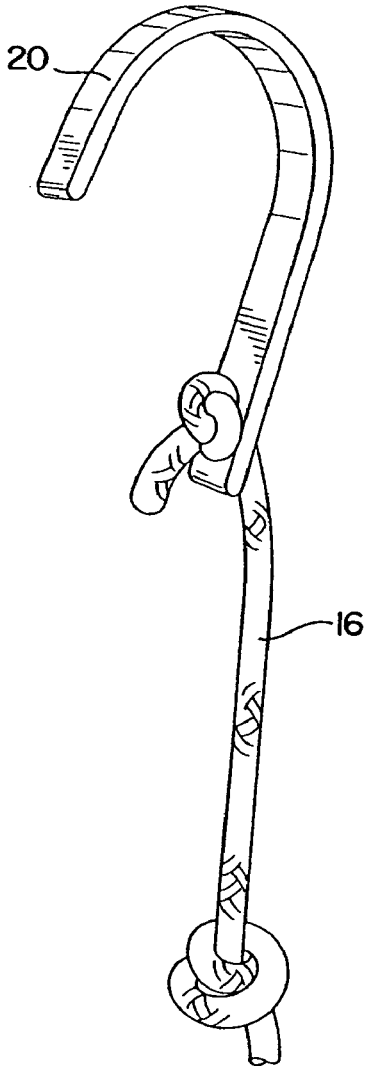
FIG. 2
FIG. 3
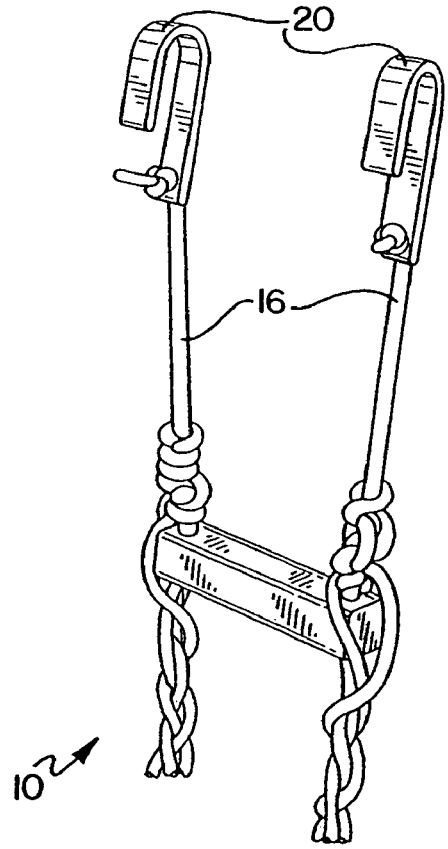

PORTABLE LADDER FOR MOUNTING A HORSE

CROSS REFERENCE TO RELATED APPLICATIONS

This application claims the benefit of U.S. Provisional Application No. 60/462,277, filed Apr. 11, 2003, having the title "Portable Ladder for Mounting a Horse," the entirety of which is herein incorporated by reference.

FIELD OF INVENTION

The present invention relates to equestrian equipment. More particularly, the present invention relates to a portable ladder for mounting a horse.

BACKGROUND

Riding is a sport and pastime with a broad appeal. Many stables house horses for their owners and also maintain their own string of horses for rental or use by members of equestrian clubs. Children especially enjoy riding. But mounting a horse is often difficult for younger children due to the relative size of the child and the horse.

A common difficulty arises due to the height of the stirrup from the ground. Typically, riders mount a horse by placing one foot in the stirrup and lifting themselves up to the height of the saddle. The rider then lifts the free leg over the saddle and sits on the saddle. Often the stirrup is too high off the ground for the child to get a toehold in the stirrup. Even if a toehold is achieved, the awkwardness of the stance makes lifting the entire body up to saddle height difficult. Further, the child may not have the strength to raise his or her body from this awkward stance.

The problem of mounting a horse, however, is not limited to children. Adults with limited mobility, for example from diseases such as multiple sclerosis and arthritis, or injury to a leg, may also lack the agility or strength to lift the entire body on one leg by means of a stirrup far above ground. Often, the adult or child requires assistance to mount the horse, whether it is from a helping hand or through the use of special equipment.

An example of special equipment is a platform, typically found in stables that are open to the public for pleasure riding. The platform is raised from the ground to substantially the height of the stirrup. The rider climbs stairs to the platform. A horse is positioned beside the platform and the rider inserts his or her foot into the stirrup. Because the stirrup is substantially at the same height as the platform on which the rider stands, the rider need not raise or lower the foot by a great distance to achieve a toehold in the stirrup.

Such equipment, however, is not portable. When on a trek or outing, the rider is compelled to remain mounted on the horse. Without the equipment, the rider would have similar problems dismounting. Moreover, once dismounted on the trek, the rider faces the same problem with remounting as he or she had with mounting the horse. Therefore, there is a need for portable equipment that allows a rider to mount and dismount a horse.

BRIEF DESCRIPTION OF THE DRAWINGS

FIG. 2 is a diagram illustrating a preferred embodiment of a saddle attachment for the portable ladder of FIG. 1;

FIG. 3 is a diagram illustrating a preferred embodiment of the pair of saddle attachments connected to the supporting members of the portable ladder of FIG. 1;

DETAILED DESCRIPTION OF THE PRESENTLY PREFERRED EMBODIMENTS

Figure 1:
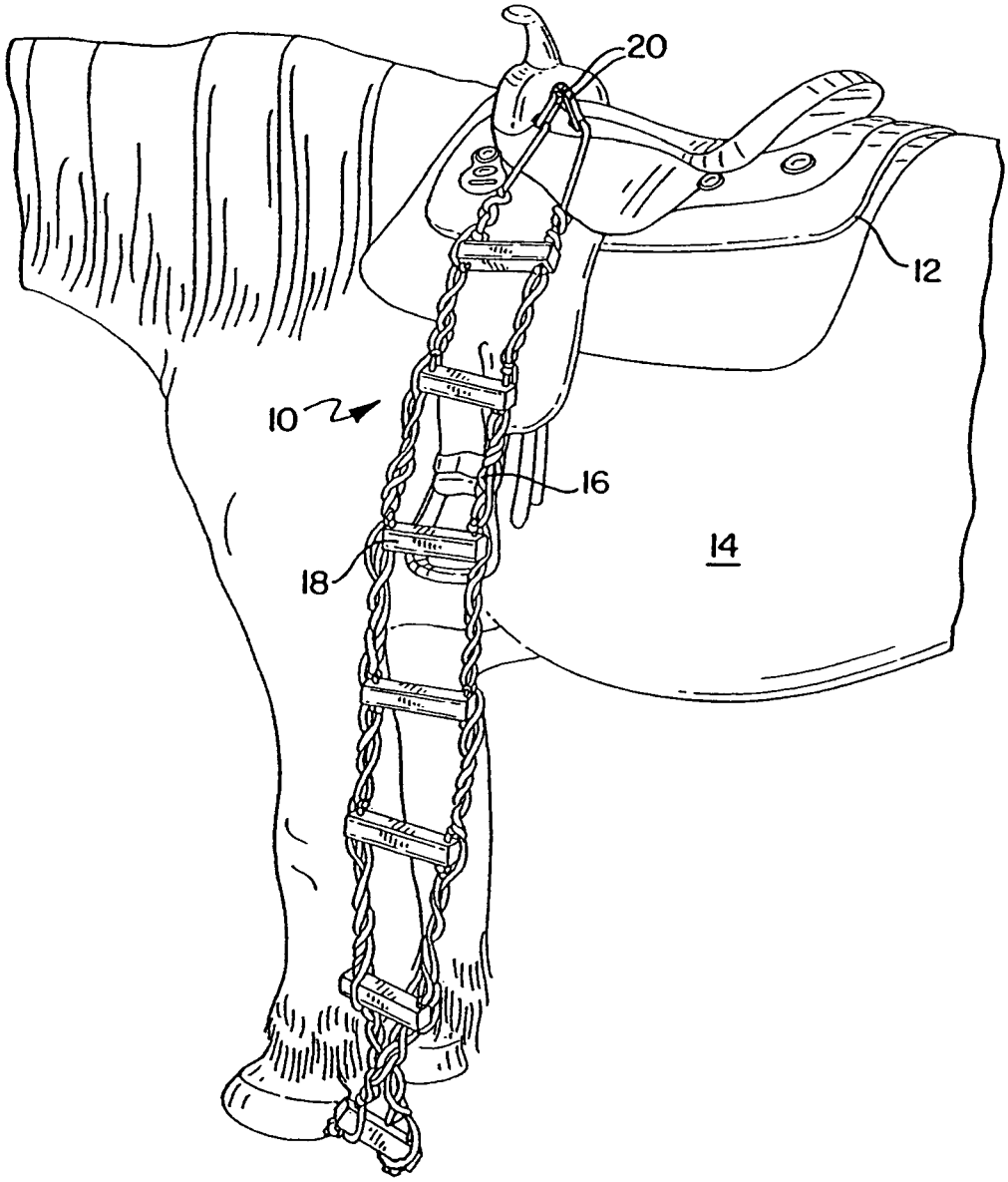
FIG. 1 is a diagram illustrating a portable ladder for mounting a horse.

FIG. 1 is a diagram illustrating an embodiment of a portable ladder 10 for mounting a horse 14. The portable ladder 10 attaches to the saddle 12 on the horse 14, allowing the rider to mount the horse 14 by climbing the ladder 10. The ladder 10 includes two flexible supporting members 16 with rungs 18 between the supporting members 16. The ladder 10 also includes a pair of saddle attachments 20 that permit the rider to attach the portable ladder 10 to the saddle 12 and detach the ladder 10 from the saddle 12. In another preferred embodiment, the ladder 10 includes a single saddle attachment to which the flexible supporting members 16 are attached.

In a preferred embodiment, the supporting members 16 are of a flexible material, such as rope. The ropes 16 may be threaded through holes in the rungs 18 and secured to the rungs 18 with knots as is known to those of ordinary skill in the art. The ropes 16 may thread through the rungs 18 multiple times to distribute the weight of the rider through multiple strands of the ropes 16 as shown in FIG. 1. Alternatively, the rungs 18 may be secured to the ropes 16 by means of other securing devices such as clamps, glue, plastic molding, or cleats.

The ropes 16 may be of natural or synthetic material. For example, natural material, such as cotton, sisal, or manila, may have the required strength to support the weight of a rider on the ladder 10. Some natural materials, however, may rot if wet or be prone to harboring germs and may be unsuitable for extensive use in the environment of a stable. Alternatively, the ropes 16 may be made of a synthetic material, such as nylon, polyethylene, polyester, or Kevlar. Although nylon is water absorbent and may not be suitable if the ladder 10 is used extensively in the rain, the synthetic materials generally have tensile strength sufficient to support the weight of a typical rider.

The ladder 10 connects to the saddle 12 by means of at least one saddle attachment 20, such as the pair of saddle attachments 20 shown in FIG. 1. FIG. 2 is a diagram illustrating a preferred embodiment of a saddle attachment 20 for the portable ladder 10 of FIG. 1. In this embodiment, each saddle attachment 20 is a hook attached to the respective supporting member 16. In a preferred embodiment, the hook 20 is composed of metal such as steel, iron, or aluminum. Alternatively, the hook 20 is composed of a hard elastomer, such as polypropylene. Each hook 20 may attach to the saddle 12 at various points on the saddle 12 as described below. FIG. 3 is a diagram illustrating a preferred embodiment of the pair of saddle attachments 20 connected to the supporting members 16 of the portable ladder 10 of FIG. 1. In this embodiment, each hook 20 is iron or steel and includes a hole through which rope 16 is threaded and knotted to secure the rope 16 to the hook 20 when the ladder 10 is in use.

In general, the materials used to construct the ladder 10 may be chosen for strength, durability, and light weight. Light weight renders the ladder 10 more portable. For example, a lightweight ladder 10, such as that illustrated in FIG. 1, is more portable, especially by children and adults of limited strength. The ladder 10 may be folded or rolled up due to the flexibility of the supporting members 16. The folded ladder 10 may then be stowed in a bag for carrying, such as a child's backpack or other container. The rungs 18 are structures composed of a material that is lightweight or can be shaped to form a lightweight structure. The structure is sufficiently strong to sustain the weight of the rider when climbing the ladder 10. In a preferred embodiment, the rungs 18 are composed of wood. In alternative embodiments, the rungs 18 are composed of a hard elastomeric material or aluminum, and are shaped to provide a sufficiently strong structure to support the rider.

Additionally, once the rider has mounted the horse 14, the rider may pull up the ladder 10, detach the ladder 10 from the saddle 12, roll or fold up the ladder 10 while mounted, and stow the folded ladder 10 on the saddle 12. For example, the saddle 12 may have saddle bags (not shown) that are accessible to the rider for stowing the ladder 10, or the saddle 12 may have a stowing area behind the seat of the saddle 12. In this manner, the rider may carry the ladder 10 while riding and deploy the ladder 10 at any time to dismount from the horse 14.

Figure 4:
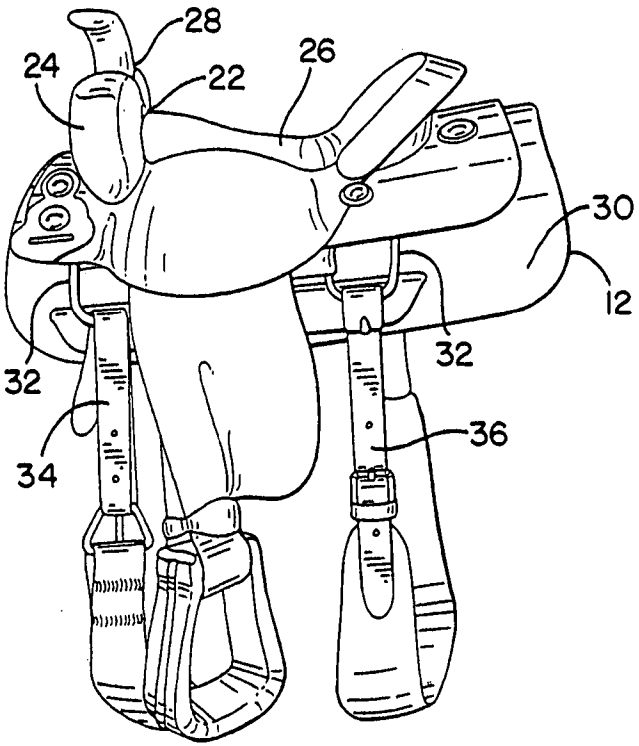
FIG. 4 is a diagram illustrating the parts of a Western saddle.

FIG. 4 is a diagram illustrating the parts of a Western saddle 12. In one preferred embodiment of the invention, the saddle attachments 20 are adapted to connect to an opening of the Western saddle 12. As is known to those of ordinary skill in the equestrian art, one such opening 22 is between the fork 24 and seat 26 of the Western saddle 12. This opening 22 is termed a "seat rise" by those of ordinary skill in the art. The opening 22 may substantially vertically accept each hook 20 to attach the ladder 10 to the saddle 12. In an alternative embodiment, the hooks 20 are adapted to connect to the horn 28 of the saddle 10. In this embodiment, each hook 20 is placed around the horn 28 in a substantially horizontal manner. It should be understood, however, that the present invention is not limited to hooks 20 that connect with the seat rise 22 or horn 28 of the saddle 12. Other openings on the saddle 12 may be used and other forms of saddle attachments 20 are possible. For example, the supporting members 16 may be sufficiently long to cross over the seat of the saddle 12 and hook under the skirt 30 of the saddle 12 on the side of the saddle 12 opposite to that of the ladder 10. Additionally, the hooks 20 may attach to either or both of the rings 32 at the top of the tie strap 34 or flank cinch billet 36 of the saddle 12. Indeed, the hooks 20 may attach to any metal rings or other structures that are sufficiently strong and firmly connected to the saddle 12.

Figure 5:
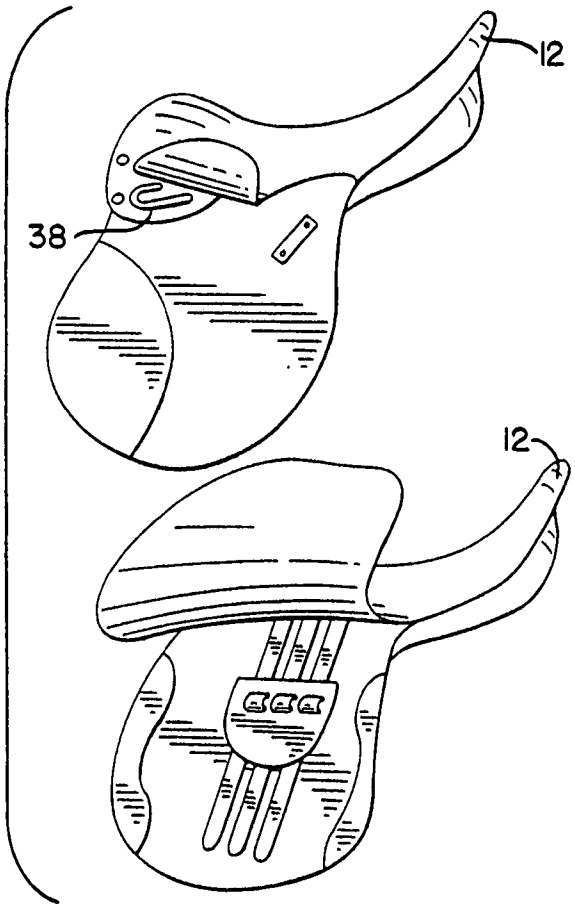
FIG. 5 is a diagram illustrating the parts of an English saddle.

FIG. 5 is a diagram illustrating the parts of an English saddle 12. In one preferred embodiment of the invention, the saddle attachments 20 are adapted to connect to the stirrup bar 38 of the English saddle 12. As is known to those of ordinary skill in the equestrian art, the stirrup bar 38 is a metal bar through which the stirrups straps are threaded. The stirrup bars 38 may substantially vertically accept each hook 20 to attach the ladder 10 to the saddle 12.

Figure 6:
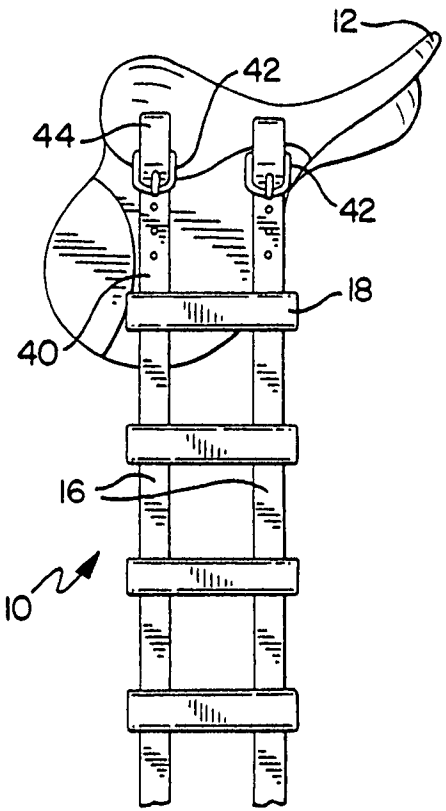
FIG. 6 is a diagram illustrating another preferred embodiment of a portable ladder.

FIG. 6 is a diagram illustrating another embodiment of the portable ladder 10. The support members 16 are leather or other flexible material that has sufficient strength to support the rider and are in the form of straps. The straps 16 are secured to the rungs 18 to form the ladder 10. In this embodiment, the top end 40 of each strap 16 includes holes that accept the tongue of a buckle 42. The buckles 42, one corresponding to each strap 16, are connected or integrated into the saddle 12. In operation, the rider passes the top end 40 of the straps 16 through the buckles 42 on the saddle 12 and fastens the buckles 42, thereby buckling the ladder 10 to the saddle 12. The rider climbs the ladder 10 to mount the horse 14. Once mounted, the rider may unbuckle the ladder 10, roll or fold the ladder 10 when mounted, and stow the folded ladder 10 on the saddle 12.

Alternatively, the buckles 42 are integrated into the saddle 12 to form specialist saddles 12 for riders who are children or adults of limited mobility. Shown in FIG. 6 is an English saddle 12 that is adapted to include the buckles 42. It should be understood, however, that the present invention is not limited to buckles 42 on English saddles 12 and that a Western saddle 12, such as that of FIG. 4, may also be adapted to include buckles 42.

In an alternative embodiment of the ladder 10 of FIG. 6, the top ends 40 of the leather straps 16 include the buckles 42, and the saddle 12 includes straps 44 with holes for securing the ladder 10 to the saddle 12. In this embodiment, the rider lifts the straps 44 on the saddle 12, passes them through the buckles 42 at the top ends 40 of the leather straps 16, and fastens the buckles 42. In either embodiment, the buckles 42 or straps 44 may be integrated with the saddle 12 through stitching or other means for attaching tack to saddles 12 as is familiar to those of ordinary skill in the equestrian art.

It should be understood, however, that the present invention is not restricted to saddle attachments 20 that are hooks, buckles, or straps. Many other saddle attachments 20 are possible. For example, the saddle attachments 20 may be a male or female part of a connector, and the saddle 12 may have integrated the other-gendered connector, such as a side release buckle or cam buckle known to those of ordinary skill in the art. Additionally, in an embodiment comprising a single saddle attachment 20, the single saddle attachment 20 may comprise a hook, buckle, strap, or a connector.

Figure 7:
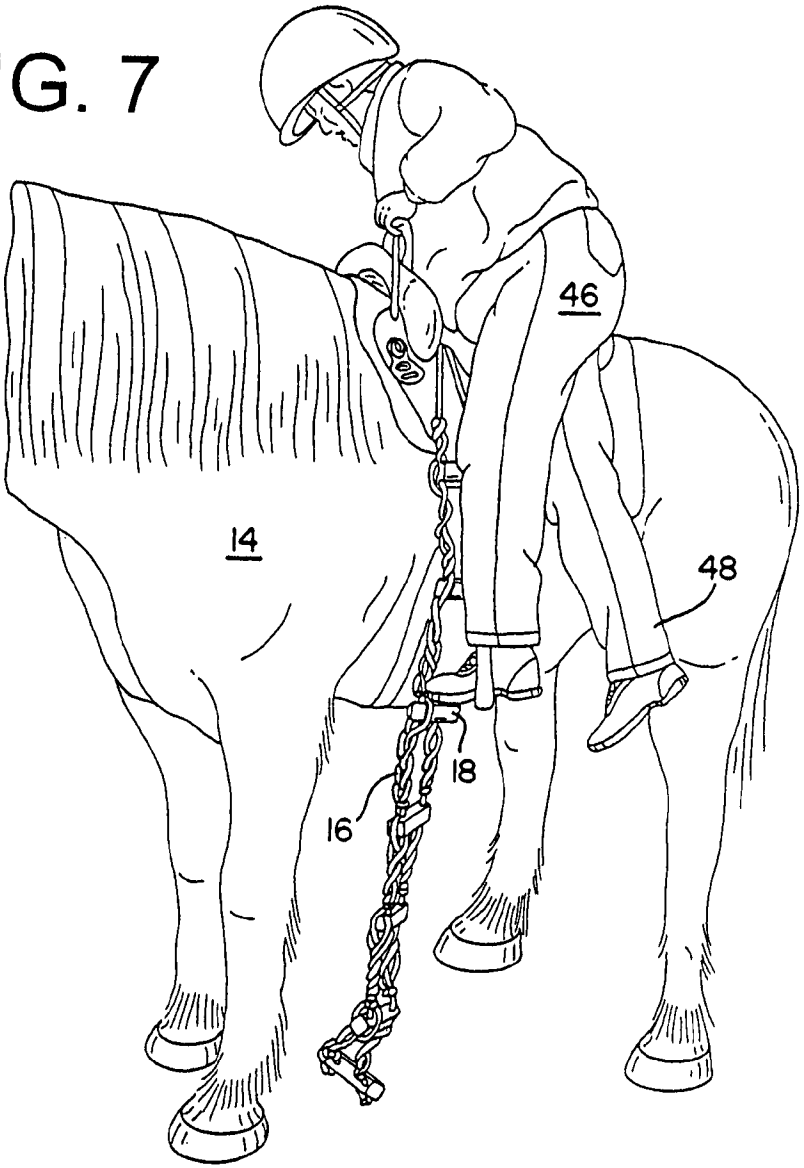
FIG. 7 is a diagram illustrating the ladder of FIG. 1 in use.

FIG. 7 is a diagram illustrating the ladder 10 of FIG. 1 in use. FIG. 7 shows the ladder 10 attached to the saddle 12 as in FIG. 1. The lowest rung of the ladder 10 is of sufficient height to allow the rider 46 to get a foothold on the ladder 10. Thereafter, the rider 46 climbs the ladder 10 by holding onto the rungs 18, the supporting members 16, or the saddle 12 as convenient. The rungs 18 may be of sufficient width to allow the rider 46 to place both feet on the same rung 16. Such a structure for the rung 16 may assist the rider 46 who has limited mobility in one leg to climb the ladder by ascending the ladder 10 through use of only the mobile leg. Once the rider reaches a sufficient and convenient height, the rider 46 may lift his or her free leg 48 over the saddle 12 to complete mounting the horse 14.

As discussed above, the rider 46 may detach the ladder 10 from the saddle 12 once mounted and roll the ladder 10 up for carrying with the saddle 12. Alternatively, the rider 46 may pull up the ladder 10 before detaching it from the saddle 12.

When dismounting, the rider 46 or another person attaches the ladder 10 to the saddle 12 as described above. The rider 46 may then gain a foothold on one of the upper rungs 18 of the ladder 10 while mounted on the horse 14. The flexibility of the ladder 10 allows it to be moved close to the rider's 46 foot to aid in gaining a foothold. The rider 46 lifts his or her free leg 48 over the saddle 12 to place the free leg 48 on the ladder 10. Thereafter, the rider 46 climbs down the ladder 10 to dismount the horse 14.

Figure 8:
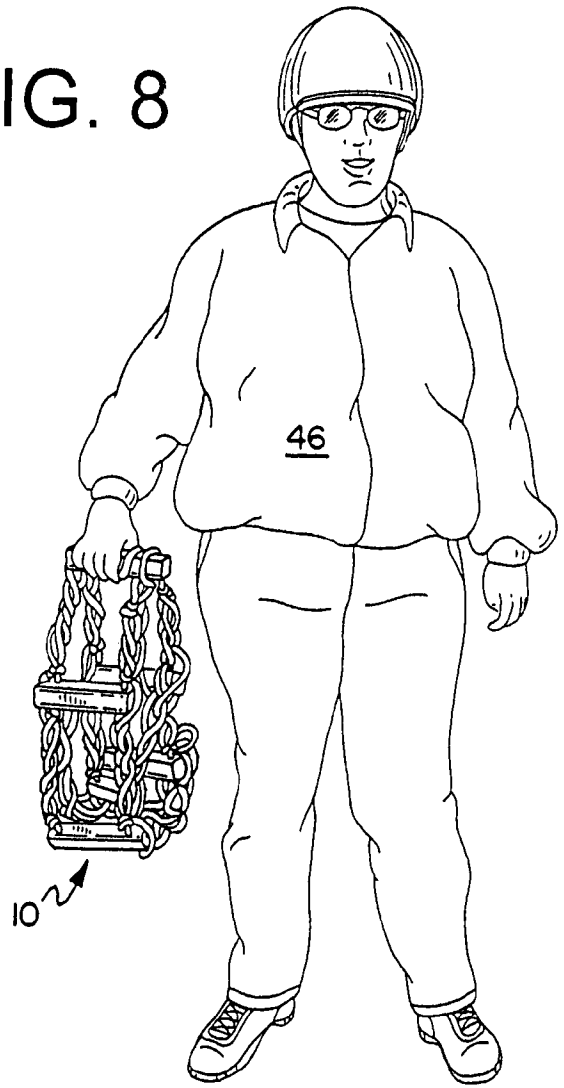
FIG. 8 is a diagram illustrating the portable ladder of FIG. 1 in a folded configuration.

FIG. 8 is a diagram illustrating the portable ladder 10 in a folded configuration. The ladder 10 may be rolled or folded up for transport. For example, the rider 46 may have a personalized portable ladder 10 for their own use. Many stables may not have the specialist equipment for assisting the rider 46 to mount a horse 14. Therefore, the rider 46 may carry his or her own ladder 10 to the stable for attachment to a Western or English saddle 12 as described above. The flexibility of the ladder 10 allows it to be folded up or otherwise deformed for carrying. In this manner, the rider 46 does not have to rely on the stable for assistance in mounting or have the uncertainty of whether the stable has the proper equipment to accommodate the rider 46.

The foregoing detailed description is merely illustrative of several embodiments of the invention. Variations of the described embodiments may be encompassed within the purview of the claims. For example, the materials of the hooks, rungs, ropes, and straps of the invention may be changed without changing the function or operation of the invention. Accordingly, any description of the embodiments in the specification should be used for general guidance, rather than to unduly restrict any broader descriptions of the elements in the following claims.

We claim:

1. A portable ladder system for mounting a horse, comprising:

a horse saddle having a ladder connection structure;

two saddle attachments detachably connected with the ladder connection structure;

a pair of flexible supporting members each having a top end, wherein the top end of each flexible supporting member is attached to a respective saddle attachment; and at least two rungs attached to and disposed between the flexible supporting members thereby forming a ladder, wherein each rung is substantially similar in size and at substantially a same separation from a neighboring rung.

2. The portable ladder of claim 1 wherein the portable ladder has length substantially equal to a distance from an attachment point on a saddle to a ground surface.

3. The portable ladder of claim 1 wherein the saddle attachments are hooks.

4. The portable ladder of claim 3 wherein each hook is composed of metal.

5. The portable ladder of claim 3 wherein each hook is composed of hard elastomer.

6. The portable ladder of claim 3 wherein the ladder connection structure is an opening of a Western saddle, and each saddle attachment is adapted to be detachably connected with said opening.

7. The portable ladder of claim 3 wherein the ladder connection structure is a horn of a Western saddle, and each saddle attachment is adapted to be detachably connected with said horn.

8. The portable ladder of claim 3 wherein the ladder connection structure is a stirrup bar of an English saddle, and each saddle attachment is adapted to be detachably connected with said stirrup bar.

9. The portable ladder of claim 1 wherein the saddle attachments are buckles for receiving a strap on a saddle.

10. The portable ladder of claim 1 wherein the saddle attachments are straps for connecting to a buckle on a saddle.

11. The portable ladder of claim 1 wherein the flexible supporting members comprise rope.

12. The portable ladder of claim 11 wherein the rope is composed of material selected from the group consisting of: nylon, polyester, polypropylene, Kevlar, cotton, manila, and sisal.

13. The portable ladder of claim 11 wherein the flexible supporting members are braided rope, and wherein each of the at least two rungs is supported by alternating strands of the braided rope.

14. The portable ladder of claim 1 wherein the flexible supporting members are leather.

15. The portable ladder system of claim 1 wherein the ladder connection structure is a gendered connector integrated into the saddle and at least one saddle attachment is an opposite gendered connector.

16. The portable ladder system of claim 1 wherein at least four rungs are attached to and disposed between the flexible supporting members.

17. A method for mounting a horse, comprising:

(a) attaching a portable ladder to a saddle on the horse, the ladder having two saddle attachments detachably connected with the ladder, a pair of flexible supporting members and at least two rungs attached to and disposed between the support members;

(b) obtaining a foothold on the ladder;

(c) climbing the portable ladder until able to mount the horse;

(d) mounting the horse;

(e) detaching the portable ladder from the saddle when mounted on the horse; and (f) storing the detached portable ladder on the saddle.

18. The method of claim 17 wherein (a) comprises:

(a1) attaching at least one hook to the saddle, wherein the saddle includes at least one attachment point for receiving the at least one hook.

19. The method of claim 18 wherein each attachment point is an opening in the saddle.

20. The method of claim 19 wherein each attachment point is the same opening in the saddle.

21. The method of claim 17 wherein (a) comprises:

(a2) attaching at least one buckle to the saddle, wherein the saddle includes at least one strap for receiving a respective buckle.

22. The method of claim 17 wherein (a) comprises:

(a3) attaching at least one strap to the saddle, wherein the saddle includes at least one buckle for receiving a respective strap.

* * * * *